US009534447B2

(12) United States Patent
Zediker et al.

(10) Patent No.: US 9,534,447 B2
(45) Date of Patent: Jan. 3, 2017

(54) APPARATUS FOR PERFORMING OIL FIELD LASER OPERATIONS

(71) Applicants: Mark S. Zediker, Castle Rock, CO (US); Mark S. Land, Houston, TX (US); Charles C. Rinzler, Boston, MA (US); Brian O. Faircloth, Evergreen, CO (US); Yeshaya Koblick, Sharon, MA (US); Joel F. Moxley, Highlands Ranch, CO (US)

(72) Inventors: Mark S. Zediker, Castle Rock, CO (US); Mark S. Land, Houston, TX (US); Charles C. Rinzler, Boston, MA (US); Brian O. Faircloth, Evergreen, CO (US); Yeshaya Koblick, Sharon, MA (US); Joel F. Moxley, Highlands Ranch, CO (US)

(73) Assignee: Foro Energy, Inc., Littleton, CO (US)

( * ) Notice: Subject to any disclaimer, the term of this patent is extended or adjusted under 35 U.S.C. 154(b) by 196 days.

(21) Appl. No.: 14/335,627

(22) Filed: Jul. 18, 2014

(65) Prior Publication Data

US 2016/0017661 A1 Jan. 21, 2016

Related U.S. Application Data

(63) Continuation of application No. 12/544,038, filed on Aug. 19, 2009, now Pat. No. 8,820,434.

(60) Provisional application No. 61/090,384, filed on Aug. 20, 2008, provisional application No. 61/102,730, filed on Oct. 3, 2008, provisional application No. 61/106,472, filed on Oct. 17, 2008, provisional application No. 61/153,271, filed on Feb. 17, 2009.

(51) Int. Cl.

| | |
|---|---|
| ***E21B 7/15*** | (2006.01) |
| ***E21B 21/08*** | (2006.01) |
| ***E21B 7/14*** | (2006.01) |
| ***E21B 10/60*** | (2006.01) |
| ***E21B 21/10*** | (2006.01) |
| ***E21B 29/00*** | (2006.01) |
| ***E21B 43/11*** | (2006.01) |
| ***E21B 21/00*** | (2006.01) |

(52) U.S. Cl.

CPC . *E21B 7/15* (2013.01); *E21B 7/14* (2013.01); *E21B 10/60* (2013.01); *E21B 21/00* (2013.01); *E21B 21/08* (2013.01); *E21B 21/103* (2013.01); *E21B 29/00* (2013.01); *E21B 43/11* (2013.01)

(58) Field of Classification Search

CPC ..... E21B 7/14; E21B 7/15; E21B 29/02; E21B 36/00; E21B 36/04

See application file for complete search history.

(56) References Cited

U.S. PATENT DOCUMENTS 7,147,064 B2 * 12/2006 Batarseh ..... E21B 7/15 175/11

2010/0044102 A1 2/2010 Rinzler

2010/0044103 A1 2/2010 Moxley (Continued)

*Primary Examiner* — Elizabeth Gitlin

(74) *Attorney, Agent, or Firm* — Glen P. Belvis; Steptoe & Johnson, LLP.

(57) ABSTRACT

A system, apparatus and methods for delivering high power laser energy to perform laser operations in oil fields and to form a borehole deep into the earth using laser energy. A laser downhole assembly for the delivery of high power laser energy to surfaces and areas in a borehole, which assembly may have laser optics and a fluid path.

26 Claims, 5 Drawing Sheets

(56) References Cited

U.S. PATENT DOCUMENTS

| | | | |
|---|---|---|---|
| 2010/0044104 | A1 | 2/2010 | Zediker |
| 2010/0044105 | A1 | 2/2010 | Faircloth |
| 2010/0044106 | A1 | 2/2010 | Zediker |
| 2010/0215326 | A1 | 8/2010 | Zediker |
| 2012/0020631 | A1 | 1/2012 | Rinzler |
| 2012/0067643 | A1 | 3/2012 | DeWitt |
| 2012/0068086 | A1 | 3/2012 | DeWitt |
| 2012/0074110 | A1 | 3/2012 | Zediker |
| 2012/0217015 | A1 | 8/2012 | Zediker |
| 2012/0217017 | A1 | 8/2012 | Zediker |
| 2012/0217018 | A1 | 8/2012 | Zediker |
| 2012/0217019 | A1 | 8/2012 | Zediker |
| 2012/0248078 | A1 | 10/2012 | Zediker |
| 2012/0255774 | A1 | 10/2012 | Grubb |
| 2012/0255933 | A1 | 10/2012 | McKay |
| 2012/0261188 | A1 | 10/2012 | Zediker |
| 2012/0266803 | A1 | 10/2012 | Zediker |
| 2012/0267168 | A1 | 10/2012 | Grubb |
| 2012/0273269 | A1 | 11/2012 | Rinzler |
| 2012/0273470 | A1 | 11/2012 | Zediker |
| 2012/0275159 | A1 | 11/2012 | Fraze |
| 2013/0011102 | A1 | 1/2013 | Rinzler |
| 2013/0175090 | A1 | 7/2013 | Zediker |
| 2013/0192893 | A1 | 8/2013 | Zediker |
| 2013/0192894 | A1 | 8/2013 | Zediker |
| 2013/0220626 | A1 | 8/2013 | Zediker |
| 2013/0228372 | A1 | 9/2013 | Linyaev |
| 2013/0228557 | A1 | 9/2013 | Zediker |
| 2013/0266031 | A1 | 10/2013 | Norton |
| 2013/0319984 | A1 | 12/2013 | Linyaev |
| 2014/0000902 | A1 | 1/2014 | Wolfe |
| 2014/0060802 | A1 | 3/2014 | Zediker |
| 2014/0060930 | A1 | 3/2014 | Zediker |
| 2014/0069896 | A1 | 3/2014 | Deutch |
| 2014/0090846 | A1 | 4/2014 | Deutch |
| 2014/0190949 | A1 | 7/2014 | Zediker |
| 2014/0231085 | A1 | 8/2014 | Zediker |
| 2014/0231398 | A1 | 8/2014 | Land |
| 2014/0248025 | A1 | 9/2014 | Rinzler |
| 2014/0345872 | A1 | 11/2014 | Zediker |

* cited by examiner

APPARATUS FOR PERFORMING OIL FIELD LASER OPERATIONS

This application is a continuation of Ser. No. 12/544,038 filed Aug. 19, 2009, which claims the benefit of priority of provisional applications: Ser. No. 61/090,384 filed Aug. 20, 2008, titled System and Methods for Borehole Drilling: Ser. No. 61/102,730 filed Oct. 3, 2008, titled Systems and Methods to Optically Pattern Rock to Chip Rock Formations; Ser. No. 61/106,472 filed Oct. 17, 2008, titled Transmission of High Optical Power Levels via Optical Fibers for applications such as Rock Drilling and Power Transmission; and, Ser. No. 61/153,271 filed Feb. 17, 2009, title Method and Apparatus for an Armored High Power Optical Fiber for Providing Boreholes in the Earth, the disclosures of which are incorporated herein by reference.

This invention was made with Government support under Award DE-AR0000044 awarded by the Office of ARPA-E U.S. Department of Energy. The Government has certain rights in this invention.

BACKGROUND OF THE INVENTION

The present invention relates to methods, apparatus and systems for delivering high power laser energy over long distances, while maintaining the power of the laser energy to perform desired tasks. In a particular, the present invention relates to a laser bottom hole assembly (LBHA) for delivering high power laser energy to the bottom of a borehole to create and advance a borehole in the earth.

In general, boreholes have been formed in the earth's surface and the earth, i.e., the ground, to access resources that are located at and below the surface. Such resources would include hydrocarbons, such as oil and natural gas, water, and geothermal energy sources, including hydrothermal wells. Boreholes have also been formed in the ground to study, sample and explore materials and formations that are located below the surface. They have also been formed in the ground to create passageways for the placement of cables and other such items below the surface of the earth.

The term borehole includes any opening that is created in the ground that is substantially longer than it is wide, such as a well, a well bore, a well hole, and other terms commonly used or known in the art to define these types of narrow long passages in the earth. Although boreholes are generally oriented substantially vertically, they may also be oriented on an angle from vertical, to and including horizontal. Thus, using a level line as representing the horizontal orientation, a borehole can range in orientation from 0° i.e., a vertical borehole, to 90°,i.e., a horizontal borehole and greater than 90° e.g., such as a heel and toe. Boreholes may further have segments or sections that have different orientations, they may be arcuate, and they may be of the shapes commonly found when directional drilling is employed. Thus, as used herein unless expressly provided otherwise, the "bottom" of the borehole, the "bottom" surface of the borehole and similar terms refer to the end of the borehole, i.e., that portion of the borehole farthest along the path of the borehole from the borehole's opening, the surface of the earth, or the borehole's beginning.

Advancing a borehole means to increase the length of the borehole. Thus, by advancing a borehole, other than a horizontal one, the depth of the borehole is also increased. Boreholes are generally formed and advanced by using mechanical drilling equipment having a rotating drilling bit. The drilling bit is extending to and into the earth and rotated to create a hole in the earth. In general, to perform the drilling operation a diamond tip tool is used. That tool must be forced against the rock or earth to be cut a with a sufficient force to exceed the shear strength of that material. Thus, in conventional drilling activity mechanical forces exceeding the shear strength of the rock or earth must be applied to that material. The material that is cut from the earth is generally known as cuttings, i.e., waste, which may be chips of rock, dust, rock fibers, and other types of materials and structures that may be created by thermal or mechanical interactions with the earth. These cuttings are typically removed from the borehole by the use of fluids, which fluids can be liquids, foams or gases.

In addition to advancing the borehole, other types of activities are performed in or related to forming a borehole, such as, work over and completion activities. These types of activities would include for example the cutting and perforating of casing and the removal of a well plug. Well casing, or casing, refers to the tubulars or other material that are used to line a wellbore. A well plug is a structure, or material that is placed in a borehole to fill and block the borehole. A well plug is intended to prevent or restrict materials from flowing in the borehole.

Typically, perforating, i.e., the perforation activity, involves the use of a perforating tool to create openings, e.g. windows, or a porosity in the casing and borehole to permit the sought after resource to flow into the borehole. Thus, perforating tools may use an explosive charge to create, or drive projectiles into the casing and the sides of the borehole to create such openings or porosities.

The above mentioned conventional ways to form and advance a borehole are referred to as mechanical techniques, or mechanical drilling techniques, because they require a mechanical interaction between the drilling equipment, e.g., the drill bit or perforation tool, and the earth or casing to transmit the force needed to cut the earth or casing.

It has been theorized that lasers could be adapted for use to form and advance a borehole. Thus, it has been theorized that laser energy from a laser source could be used to cut rock and earth through spalling, thermal dissociation, melting, vaporization and combinations of these phenomena. Melting involves the transition of rock and earth from a solid to a liquid state. Vaporization involves the transition of rock and earth from either a solid or liquid state to a gaseous state. Spalling involves the fragmentation of rock from localized heat induced stress effects. Thermal dissociation involves the breaking of chemical bonds at the molecular level.

To date it is believed that no one has succeeded in developing and implementing these laser drilling theories to provide an apparatus, method or system that can advance a borehole through the earth using a laser, or perform perforations in a well using a laser. Moreover, to date it is believed that no one has developed the parameters, and the equipment needed to meet those parameters, for the effective cutting and removal of rock and earth from the bottom of a borehole using a laser, nor has anyone developed the parameters and equipment need to meet those parameters for the effective perforation of a well using a laser. Further is it believed that no one has developed the parameters, equipment or methods need to advance a borehole deep into the earth, to depths exceeding about 300 ft (0.09 km), 500 ft (0.15 km), 1000 ft, (0.30 km), 3,280 ft (1 km), 9,840 ft (3 km) and 16,400 ft (5 km), using a laser. In particular, it is believed that no one has developed parameters, equipments, or methods nor implemented the delivery of high power laser energy, i.e., in excess of 1 kW or more to advance a borehole within the earth.

While mechanical drilling has advanced and is efficient in many types of geological formations, it is believed that a highly efficient means to create boreholes through harder geologic formations, such as basalt and granite has yet to be developed. Thus, the present invention provides solutions to this need by providing parameters, equipment and techniques for using a laser for advancing a borehole in a highly efficient manner through harder rock formations, such as basalt and granite.

The environment and great distances that are present inside of a borehole in the earth can be very harsh and demanding upon optical fibers, optics, and packaging. Thus, there is a need for methods and an apparatus for the deployment of optical fibers, optics, and packaging into a borehole, and in particular very deep boreholes, that will enable these and all associated components to withstand and resist the dirt, pressure and temperature present in the borehole and overcome or mitigate the power losses that occur when transmitting high power laser beams over long distances. The present inventions address these needs by providing a long distance high powered laser beam transmission means.

It has been desirable, but prior to the present invention believed to have never been obtained, to deliver a high power laser beam over a distance within a borehole greater than about 300 ft (0.90 km), about 500 ft (0.15 km), about 1000 ft, (0.30 km), about 3,280 ft (1 km), about 9,8430 ft (3 km) and about 16,400 ft (5 km) down an optical fiber in a borehole, to minimize the optical power losses due to non-linear phenomenon, and to enable the efficient delivery of high power at the end of the optical fiber. Thus, the efficient transmission of high power from point A to point B where the distance between point A and point B within a borehole is greater than about 1,640 ft (0.5 km) has long been desirable, but prior to the present invention is believed to have never been obtainable and specifically believed to have never been obtained in a borehole drilling activity. The present invention addresses this need by providing an LBHA and laser optics to deliver a high powered laser beam to downhole surfaces in a borehole.

A conventional drilling rig, which delivers power from the surface by mechanical means, must create a force on the rock that exceeds the shear strength of the rock being drilled. Although a laser has been shown to effectively spall and chip such hard rocks in the laboratory under laboratory conditions, and it has been theorized that a laser could cut such hard rocks at superior net rates than mechanical drilling, to date it is believed that no one has developed the apparatus systems or methods that would enable the delivery of the laser beam to the bottom of a borehole that is greater than about 1,640 ft (0.5 km) in depth with sufficient power to cut such hard rocks, let alone cut such hard rocks at rates that were equivalent to and faster than conventional mechanical drilling. It is believed that this failure of the art was a fundamental and long standing problem for which the present invention provides a solution.

The environment and great distances that are present inside of a borehole in the earth can be harsh and demanding upon optics and optical fibers. Thus, there is a need for methods and an apparatus for the delivery of high power laser energy very deep in boreholes that will enable the delivery device to withstand and resist the dirt, pressure and temperature present in the borehole. The present invention addresses this need by providing an LBHA and laser optics to deliver a high powered laser beam to downhole surfaces of a borehole.

Thus the present invention addresses and provides solutions to these and other needs in the drilling arts by providing, among other things an LBHA and laser optics that deliver a shaped high powered laser beam energy to the surfaces of a borehole.

SUMMARY

It is desirable to develop systems and methods that provide for the delivery of high power laser energy to the bottom of a deep borehole to advance that borehole at a cost effect rate, and in particular, to be able to deliver such high power laser energy to drill through rock layer formations including granite, basalt, sandstone, dolomite, sand, salt, limestone, rhyolite, quartzite and shale rock at a cost effective rate. More particularly, it is desirable to develop systems and methods that provide for the ability to be able to deliver such high power laser energy to drill through hard rock layer formations, such as granite and basalt, at a rate that is superior to prior conventional mechanical drilling operations. The present invention, among other things, solves these needs by providing the system, apparatus and methods taught herein.

Thus, there is provided a laser bottom hole assembly comprising: a first rotating housing; a second fixed housing; the first housing being rotationally associated with the second housing; a fiber optic cable for transmitting a laser beam, the cable having a proximal end and a distal end, the proximal end adapted to receive a laser beam from a laser source, the distal end optically associated with an optical assembly; at least a portion of the optical assembly fixed to the first rotating housing, whereby the fixed portion rotates with the first housing; a mechanical assembly fixed to the first rotating housing, whereby the assembly rotates with the first housing and is capable of applying mechanical forces to a surface of a borehole upon rotation; and, a fluid path associated with first and second housings, the fluid path having a distal and proximal opening, the distal opening adapted to discharge the fluid toward the surface of the borehole, whereby fluid for removal of waste material is transmitted by the fluid path and discharged from the distal opening toward the borehole surface to remove waste material from the borehole.

There is further provided a laser bottom hole assembly comprising: a first rotating housing; a second fixed housing; the first housing being rotationally associated with the second housing; an optical assembly, the assembly having a first portion and a second portion; a fiber optic cable for transmitting a laser beam, the cable having a proximal end and a distal end, the proximal end adapted to receive a laser beam from a laser source, the distal end optically associated with the optical assembly; the fiber proximal and distal ends fixed to the second housing; the first portion of the optical assembly fixed to the first rotating housing; the second portion of the optical assembly fixed to the second fixed housing, whereby the first portion of the optical assembly rotates with the first housing; a mechanical assembly fixed to the first rotating housing, whereby the assembly rotates with the first housing and is capable of apply mechanical forces to a surface of a borehole upon rotation; and, a fluid path associated with first and second housings, the fluid path having a distal and proximal opening, the distal opening adapted to discharge the fluid toward the surface of the borehole, the distal opening fixed to the first rotating housing, whereby fluid for removal of waste material is transmitted by the fluid path and discharged from the distal opening toward the borehole surface to remove waste material from the borehole; wherein upon rotation of the first housing the optical assembly first portion, the mechanical assembly and proximal fluid opening rotate substantially concurrently.

Still further there is provided a laser bottom hole assembly comprising: a first rotating housing; a second fixed housing; the first housing being rotationally associated with the second housing; a motor for rotating the first housing; a fiber optic cable for transmitting a laser beam, the cable having a proximal end and a distal end, the proximal end adapted to receive a laser beam from a laser source, the distal end optically associated with an optical assembly; at least a portion of the optical assembly fixed to the first rotating housing, whereby the fixed portion rotates with the first housing; a mechanical assembly fixed to the first rotating housing, whereby the assembly rotates with the first housing and is capable of apply mechanical forces to a surface of a borehole upon rotation; and, a fluid path associated with first and second housings, the fluid path having a distal and proximal opening, the distal opening adapted to discharge the fluid toward the surface of the borehole, whereby fluid for removal of waste material is transmitted by the fluid path and discharged from the distal opening toward the borehole surface to remove waste material from the borehole.

Moreover there is provided a laser bottom hole assembly comprising: a means for providing rotation; a means for providing a high power laser beam; a means for manipulating the laser beam; a means for mechanically removing material; a means for providing a fluid flow; and, a means for coupling the rotation means, the manipulation means, the mechanical removal means, and the fluid flow means to provide simultaneous and uniform rotation of said means. Further and by way of illustration the means for rotation may comprise a housing, the housing may comprise a first part and a second part wherein the first part of the housing may be fixed and the second part of the housing may be rotatable, the means for providing a high power laser beam may be a fiber optic cable, the means for providing a high power laser beam may comprise a plurality of fiber optic cables, or the first part of the housing may rotate and the second part of the housing may be fixed.

Additionally there is provided a laser bottom hole assembly comprising: a housing; a means for providing a high power laser beam; an optical assembly, the optical assembly providing an optical path upon which the laser beam travels; and, a means for creating an area of high pressure along the optical path; and, a means for providing aspiration pumping for the removal of waste material from the area of high pressure.

Still further there is provided a high power laser drilling system for advancing a borehole having at least about 500 feet, 1000 feet, or 5000 feet of tubing, having a distal end and a proximal and the tubing comprising a high power laser transmission cable, the transmission cable having a distal end and a proximal end, the proximal end being in optical communication with the laser source, whereby the laser beam is transmitted by the cable from the proximal end to the distal end of the cable for delivery of the laser beam energy to a laser bottom hole assembly which has a housing; and, an optical assembly. Further the bottom hole assembly may have beam shaping optics, a means for rotating a housing, a means for directing a fluid for removal of waste material, a means for keeping a laser path free of debris, or a means for reducing the interference of waste material with the laser beam.

Furthermore, these systems and assemblies may further have rotating laser optics, a rotating mechanical interaction device, a rotating fluid delivery means, one or all three of these devices rotating together, beam shaping optic, housings, a means for directing a fluid for removal of waste material, a means for keeping a laser path free of debris, a means for reducing the interference of waste material with the laser beam, optics comprising a scanner; a stand-off mechanical device, a conical stand-off device, a mechanical assembly comprises a drill bit, a mechanical assembly comprising a three-cone drill bit, a mechanical assembly comprises a PDC bit, a PDC tool or a PDC cutting tool.

One of ordinary skill in the art will recognize, based on the teachings set forth in these specifications and drawings, that there are various embodiments and implementations of these teachings to practice the present invention. Accordingly, the embodiments in this summary are not meant to limit these teachings in any way.

DESCRIPTION OF THE DRAWINGS AND THE PREFERRED EMBODIMENTS

Figure 1A:
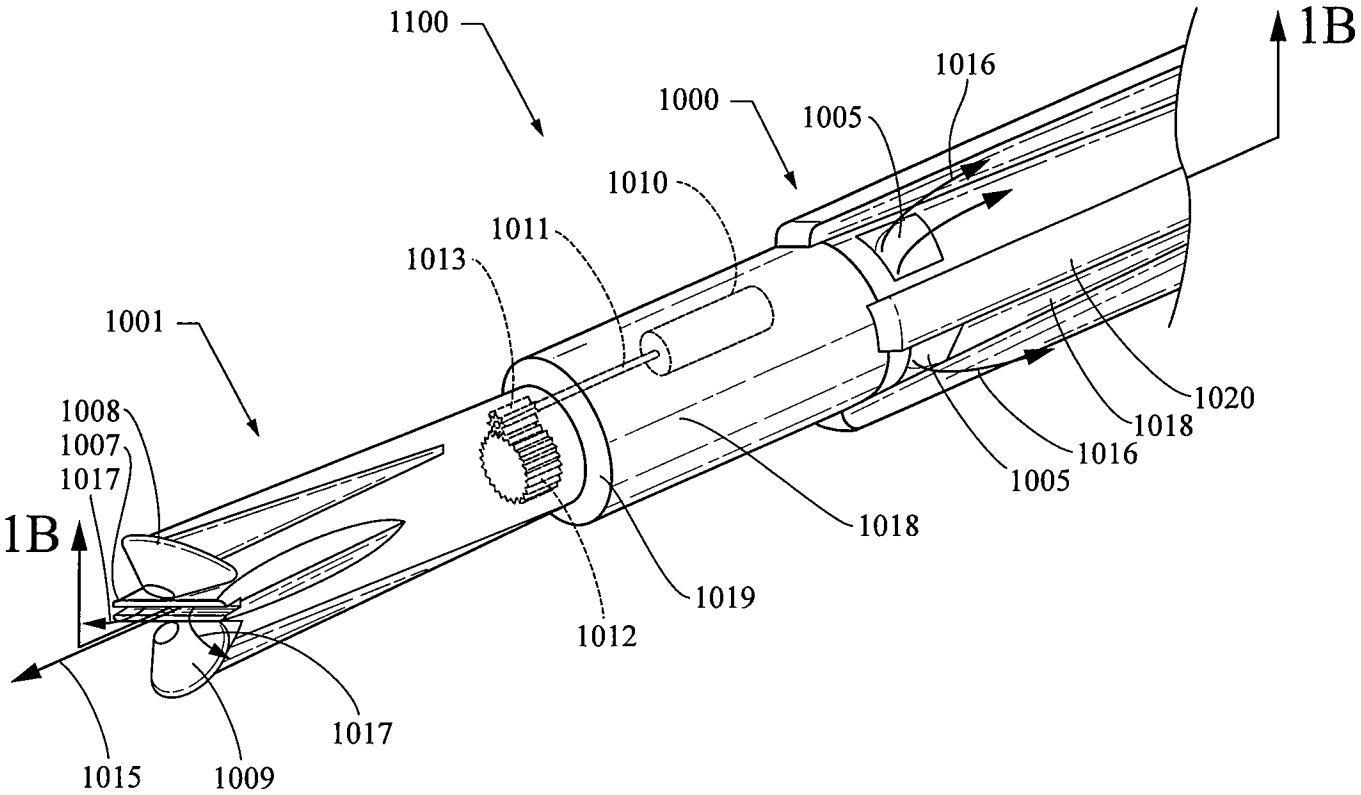
FIG. 1A is a perspective view of a LBHA.

In general, the present inventions relate to methods, apparatus and systems for use in laser drilling of a borehole in the earth, and further, relate to equipment, methods and systems for the laser advancing of such boreholes deep into the earth and at highly efficient advancement rates. These highly efficient advancement rates are obtainable in part because the present invention provides for a laser bottom hole assembly (LBHA) that shapes and delivers the high power laser energy to the surfaces of the borehole. As used herein the term "earth" should be given its broadest possible meaning (unless expressly stated otherwise) and would include, without limitation, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

In general, one or more laser beams generated or illuminated by one or more lasers may spall, vaporize or melt material such as rock or earth. The laser beam may be pulsed by one or a plurality of waveforms or it may be continuous. The laser beam may generally induce thermal stress in a rock formation due to characteristics of the rock including, for example, the thermal conductivity. The laser beam may also induce mechanical stress via superheated steam explosions of moisture in the subsurface of the rock formation. Mechanical stress may also be induced by thermal decomposition and sublimation of part of the in situ minerals of the material. Thermal and/or mechanical stress at or below a laser-material interface may promote spallation of the material, such as rock. Likewise, the laser may be used to effect well casings, cement or other bodies of material as desired. A laser beam may generally act on a surface at a location where the laser beam contacts the surface, which may be referred to as a region of laser illumination. The region of laser illumination may have any preselected shape and intensity distribution that is required to accomplish the desired outcome, the laser illumination region may also be referred to as a laser beam spot. Boreholes of any depth and/or diameter may be formed, such as by spalling multiple points or layers. Thus, by way of example, consecutive points may be targeted or a strategic pattern of points may be targeted to enhance laser/rock interaction. The position or orientation of the laser or laser beam may be moved or directed so as to intelligently act across a desired area such that the laser/material interactions are most efficient at causing rock removal.

Generally in downhole operations including drilling, completion, and workover, the bottom hole assembly is an assembly of equipment that typically is positioned at the end of a cable, wireline, umbilical, string of tubulars, string of drill pipe, or coiled tubing and is lower into and out of a borehole. It is this assembly that typically is directly involved with the drilling, completion, or workover operation and facilitates an interaction with the surfaces of the borehole, casing, or formation to advance or otherwise enhance the borehole as desired.

In general, the LBHA of the present invention may contain an outer housing that is capable of withstanding the conditions of a downhole environment, a source of a high power laser beam, and optics for the shaping and directing a laser beam on the desired surfaces of the borehole, casing, or formation. The high power laser beam may be greater than about 1 kW, from about 2 kW to about 20 kW, greater than about 5 kW, from about 5 kW to about 10 kW, at least about 10 kW, preferably at least about 15 kW, and more preferably at least about 20 kW. The assembly may further contain or be associated with a system for delivering and directing fluid to the desired location in the borehole, a system for reducing or controlling or managing debris in the laser beam path to the material surface, a means to control or manage the temperature of the optics, a means to control or manage the pressure surrounding the optics, and other components of the assembly, and monitoring and measuring equipment and apparatus, as well as, other types of downhole equipment that are used in conventional mechanical drilling operations. Further, the LBHA may incorporate a means to enable the optics to shape and propagate the beam which for example would include a means to control the index of refraction of the environment through which the laser is propagating. Thus, as used herein the terms control and manage are understood to be used in their broadest sense and would include active and passive measures as well as design choices and materials choices.

The LBHA should be construed to withstand the conditions found in boreholes including boreholes having depths of about 1,640 ft (0.5 km) or more, about 3,280 ft (1 km) or more, about 9,830 ft (3 km) or more, about 16,400 ft (5 km) or more, and up to and including about 22,970 ft (7 km) or more. While drilling, i.e. advancement of the borehole, is taking place the desired location in the borehole may have dust, drilling fluid, and/or cuttings present. Thus, the LBHA should be constructed of materials that can withstand these pressures, temperatures, flows, and conditions, and protect the laser optics that are contained in the LBHA. Further, the LBHA should be designed and engineered to withstand the downhole temperatures, pressures, and flows and conditions while managing the adverse effects of the conditions on the operation of the laser optics and the delivery of the laser beam.

The LBHA should also be constructed to handle and deliver high power laser energy at these depths and under the extreme conditions present in these deep downhole environments. Thus, the LBHA and its laser optics should be capable of handling and delivering laser beams having energies of 1 kW or more, 5 kW or more, 10 kW or more and 20 kW or more. This assembly and optics should also be capable of delivering such laser beams at depths of about 1,640 ft (0.5 km) or more, about 3,280 ft (1 km) or more, about 9,830 ft (3 km) or more, about 16,400 ft (5 km) or more, and up to and including about 22,970 ft (7 km) or more.

The LBHA should also be able to operate in these extreme downhole environments for extended periods of time. The lowering and raising of a bottom hole assembly has been referred to as tripping in and tripping out. While the bottom hole assembling is being tripped in or out the borehole is not being advanced. Thus, reducing the number of times that the bottom hole assembly needs to be tripped in and out will reduce the critical path for advancing the borehole, i.e., drilling the well, and thus will reduce the cost of such drilling. (As used herein the critical path referrers to the least number of steps that must be performed in serial to complete the well.) This cost savings equates to an increase in the drilling rate efficiency. Thus, reducing the number of times that the bottom hole assembly needs to be removed from the borehole directly corresponds to reductions in the time it takes to drill the well and the cost for such drilling. Moreover, since most drilling activities are based upon day rates for drilling rigs, reducing the number of days to complete a borehole will provided a substantial commercial benefit. Thus, the LBHA and its laser optics should be capable of handling and delivering laser beams having energies of 1 kW or more, 5 kW or more, 10 kW or more and 20 kW or more at depths of about 1,640 ft (0.5 km) or more, about 3,280 ft (1 km) or more, about 9,830 ft (3 km) or more, about 16,400 ft (5 km) or more, and up to and including about 22,970 ft (7 km) or more, for at least about ½ hr or more, at least about 1 hr or more, at least about 2 hours or more, at least about 5 hours or more, and at least about 10 hours or more, and preferably longer than any other limiting factor in the advancement of a borehole. In this way using the LBHA of the present invention could reduce tripping activities to only those that are related to casing and completion activities, greatly reducing the cost for drilling the well.

By way of example, and without limitation to other spot and beam parameters and combinations thereof, the LBHA and optics should be capable of creating and maintain the laser beam parameters set out in Table 1 in deep downhole environments.

TABLE 1

| Example | | Laser Beam Parameters |
|---|---|---|
| 1 | Beam Spot Size (circular or (elliptical)) | 0.3585", 0.0625" (12.5 mm, 0.5 mm), 0.1", |
| | Exposure Times | 0.05 s, 0.1 s, 0.2 s, 0.5 s, 1 s |
| | Time-average Power | 0.25 kW, 0.5 kW, 1.6 kW, 3 kW, 5 kW |
| 2 | Beam Type | CW/Collimated |
| | Beam Spot Size (circular or (elliptical)) | 0.0625" (12.5 mm × 0.5 mm), 0.1" |
| | Power | 0.25 kW, 0.5 kW, 1.6 kW, 3 kW, 5 kW |
| 3 | Beam Type | CW/Collimated and Pulsed at Spallation Zones |
| | Specific Power | Spallation zones (920 W/cm2 at ~2.6 kJ/cc for Sandstone &4 kW/cm2 at ~0.52 kJ/cc for Limestone) |
| | Beam Size | 12.5 mm × 0.5 mm |
| 4 | Beam Type | CW/Collimated or Pulsed at Spallation Zones |

TABLE 1-continued

| Example | Laser Beam Parameters | |
|---|---|---|
| | Specific Power | Spallation zones (~920 W/cm2 at ~2.6 kJ/cc for Sandstone &4 kW/cm2 at ~0.52 kJ/cc for Limestone) |
| | Beam Size | 12.5 mm × 0.5 mm |
| 5 | Beam Type | CW/Collimated or Pulsed at Spallation Zones |
| | Specific Power | Spallation zones {~920 W/cm2 at −2.6 kJ/cc for Sandstone &4 kW/cm2 at ~0.52 kJ/cc for Limestone) |
| 6 | Beam Type | CW/Collimated or Pulsed at Spallation Zones |
| | Specific Power | illumination zones {~10,000 W/cm2 at −1 kJ/cc for Sandstone & 10,000 W/cm2 at ~5 kJ/cc for Limestone) |
| | Beam Size | 50 mm × 10 mm; 50 mm × 0.5 mm; 150 mm × 0.5 mm |

The LBHA, by way of example, may include one or more optical manipulators. An optical manipulator may generally control a laser beam, such as by directing or positioning the laser beam to remove material, such as rock. In some configurations, an optical manipulator may strategically guide a laser beam to remove material, such as rock. For example, spatial distance from a borehole wall or rock may be controlled, as well as impact angle. In some configurations, one or more steerable optical manipulators may control the direction and spatial width of the one or more laser beams by one or more reflective mirrors or crystal reflectors. In other configurations, the optical manipulator can be steered by, but steering means not being limited to, an electro-optic switch, electroactive polymers, galvanometers, piezoelectrics, rotary/linear motors, and/or active-phase control of an array of sources for electronic beam steering. In at least one configuration, an infrared diode laser or fiber laser optical head may generally rotate about a vertical axis to increase aperture contact length. Various programmable values such as specific energy, specific power, pulse rate, duration and the like may be implemented as a function of time. Thus, where to apply energy may be strategically determined, programmed and executed so as to enhance a rate of penetration, the efficiency of borehole advancement, and/or laser/rock interaction. One or more algorithms may be used to control the optical manipulator.

The LBHA and optics, in at least one aspect, provide that a beam spot pattern and continuous beam shape may be formed by a refractive, reflective, diffractive or transmissive grating optical element. refractive, reflective, diffractive or transmissive grating optical elements may be made, but are not limited to being made, of fused silica, quartz, ZnSe, Si, GaAs, polished metal, sapphire, and/or diamond. These may be, but are not limited to being, optically coated with the said materials to reduce or enhance the reflectivity.

In accordance with one or more aspects, one or more fiber optic distal fiber ends may be arranged in a pattern. The multiplexed beam shape may comprise a cross, an x shape, a viewfinder, a rectangle, a hexagon, lines in an array, or a related shape where lines, squares, and cylinders are connected or spaced at different distances.

In accordance with one or more aspects, one or more refractive lenses, diffractive elements, transmissive gratings, and/or reflective lenses may be added to focus, scan, and/or change the beam spot pattern from the beam spots emitting from the fiber optics that are positioned in a pattern. One or more refractive lenses, diffractive elements, transmissive gratings, and/or reflective lenses may be added to focus, scan, and/or change the one or more continuous beam shapes from the light emitted from the beam shaping optics. A collimator may be positioned after the beam spot shaper lens in the transversing optical path plane. The collimator may be an aspheric lens, spherical lens system composed of a convex lens, thick convex lens, negative meniscus, and bi-convex lens, gradient refractive lens with an aspheric profile and achromatic doublets. The collimator may be made of the said materials, fused silica, ZnSe, SF glass, or a related material. The collimator may be coated to reduce or enhance reflectivity or transmission. Said optical elements may be cooled by a purging liquid or gas.

In some aspects, the one or more fiber optics with one or more said optical elements and beam spot lens shaper lenses may be steered in the z-direction to keep the focal path constant and rotated by a stepper motor, servo motors, piezoelectric motors, liquid or gas actuator motor, and electro-optics switches. The z-axis may be controlled by the drill string or mechanical standoff. The steering may be mounted to one or more stepper rails, gantry's, gimbals, hydraulic line, elevators, pistons, springs. The one or more fiber optics with one or more fiber optics with one or more said beam spot shaping lens and one or more collimator's may be rotated by a stepper motor, servo motors, piezoelectric motors, liquid or gas actuator motor, and electro-optic switch. The steering may be mounted to one or more stepper rails, gantry's, gimbals, hydraulic line, elevators, pistons, springs.

In some aspects, the fiber optics and said one or more optical elements lenses and beam shaping optics may be encased in a protective optical head made of, for example, the materials steel, chrome-moly steel, steel cladded with hard-face materials such as an alloy of chromium-nickel-cobalt, titanium, tungsten carbide, diamond, sapphire, or other suitable materials known to those in the art which may have a transmissive window cut out to emit the light through the optical head.

In accordance with one or more aspects, a laser source may be coupled to a plurality of optical fiber bundles with the distal end of the fiber arranged to combine fibers together to form bundle pairs, such that the power density through one fiber bundle pair is within the removal zone, e.g., spallation or vaporization zone, and one or more beam spots illuminate the material, such as rock with the bundle pairs arranged in a patter to remove or displace the rock formation.

In accordance with one or more aspects, the pattern of the bundle pairs may be spaced in such a way that the light from the fiber bundle pairs emerge in one or more beam spot patterns that comprise the geometry of a rectangular grid, a circle, a hexagon, a cross, a star, a bowtie, a triangle, multiple lines in an array, multiple lines spaced a distance apart non-linearly, an ellipse, two or more lines at an angle, or a related shape. The pattern of the bundle pairs may be spaced in such a way that the light from the fiber bundles emerge as one or more continuous beam shapes that comprise above geometries. A collimator may be positioned at a said distance in the same plane below the distal end of the fiber bundle pairs. One or more beam shaping optics may be positioned at a distance in the same plane below the distal end of the fiber bundle pairs. An optical element such as a non-axis-symmetric lens may be positioned at a said distance in the same plane below the distal end of the fiber bundle pairs. Said optical elements may be positioned at an angle to the rock formation and rotated on an axis.

In accordance with one or more aspects, the distal fiber end made up of fiber bundle pairs may be steered in the X,Y,Z, planes and rotationally using a stepper motor, servo motors, piezoelectric motors, liquid or gas actuator motor. The distal fiber end may be made up of fiber bundle pairs being steered with a collimator or other optical element, which could be an objective, such as a non-axis-symmetric optical element. The steering may be mounted to one or more mechanical, hydraulic, or electro-mechanical element to move the optical element. The distal end of fiber bundle pairs, and optics may be protected as described above. The optical fibers may be single-mode and/or multimode. The optical fiber bundles may be composed of single-mode and/or multimode fibers.

It is readily understood in the art that the terms lens and optic(al) elements, as used herein is used in its broadest terms and thus may also refer to any optical elements with power, such as reflective, transmissive or refractive elements, In some aspects, the optical fibers may be entirely constructed of glass, hollow core photonic crystals, and/or solid core photonic crystals. The optical fibers may be jacketed with materials such as, polyimide, acrylate, carbon polyamide, or carbon/dual acrylate. Light may be sourced from a diode laser, disk laser, chemical laser, fiber laser, or fiber optic source is focused by one or more positive refractive lenses. Further, examples of fibers useful for the transmission of high powered laser energy over long distance in conjunction with the present invention are provided in patent application Ser. No. 12/544,136, which issued as U.S. Pat. No. 8,511,401, the disclosure of which is incorporated herein.

In at least one aspect, the positive refractive lens types may include, a non-axis-symmetric optic such as a piano-convex lens, a biconvex lens, a positive meniscus lens, or a gradient refractive index lens with a piano-convex gradient profile, a biconvex gradient profile, or positive meniscus gradient profile to focus one or more beams spots to the rock formation. A positive refractive lens may be comprised of the materials, fused silica, sapphire, ZnSe, or diamond. Said refractive lens optical elements can be steered in the light propagating plane to increase/decrease the focal length. The light output from the fiber optic source may originate from a plurality of one or more optical fiber bundle pairs forming a beam shape or beam spot pattern and propagating the light to the one or more positive refractive lenses.

In some aspects, the refractive positive lens may be a microlens. The microlens can be steered in the light propagating plane to increase/decrease the focal length as well as perpendicular to the light propagating plane to translate the beam. The microlens may receive incident light to focus to multiple foci from one or more optical fibers, optical fiber bundle pairs, fiber lasers, diode lasers; and receive and send light from one or more collimators, positive refractive lenses, negative refractive lenses, one or more mirrors, diffractive and reflective optical beam expanders, and prisms.

In some aspects, a diffractive optical element beam splitter could be used in conjunction with a refractive lens. The diffractive optical element beam splitter may form double beam spots or a pattern of beam spots comprising the shapes and patterns set forth above.

In at least one aspect, the positive refractive lens may focus the multiple beam spots to multiple foci. To remove or displace the rock formation.

In accordance with one or more aspects, a collimator lens may be positioned in the same plane and in front of a refractive or reflective diffraction beam splitter to form a beam spot pattern or beam shape; where a beam expander feeds the light into the collimator. The optical elements may be positioned in the X,Y,Z plane and rotated mechanically.

In accordance with one or more aspects, the laser beam spot to the transversing mirror may be controlled by a beam expander. The beam expander may expand the size of the beam and send the beam to a collimator and then to a scanner of two mirrors positioning the laser beam in the XY, YZ, or XZ axis. A beam expander may expand the size of the beam and sends the beam to a collimator, then to a diffractive or reflective optical element, and then to a scanner of two mirrors positioning the laser beam in the XY, YZ, or XZ axis. A beam expander may expand the size of the beam and send the beam to a beam splitter attached behind a positive refractive lens, that splits the beam and focuses is, to a scanner of two mirrors positioning the laser beam in the XY, YZ, or XZ axis.

In some aspects, the material, such as a rock surface may be imaged by a camera downhole. Data received by the camera may be used to remove or displace the rock. Further spectroscopy may be used to determine the rock morphology, which information may be used to determine process parameters for removal of material.

In at least one aspect, a gas or liquid purge is employed. The purge gas or liquid may remove or displace the cuttings, rock, or other debris from the borehole. The fluid temperature may be varied to enhance rock removal, and provide cooling.

In accordance with some embodiments, one or more beam shaping optics may generate one or more beam spot lines, circles or squares from the light emitted by one or more fiber optics or fiber optic bundles. The beam shapes generated by a beam shaper may comprise of being Gaussian, a circular top-hat ring, or line, or rectangle, a polynomial towards the edge ring, or line, or rectangle, a polynomial towards the center ring, or line, or rectangle, a X or Y axis polynomial in a ring, or line, or rectangle, or a asymmetric beam shape beams. One or more beam shaping optics can be positioned in a pattern to form beam shapes. In another embodiment, an optic can be positioned to refocus light from one or more fiber optics or plurality of fiber optics. The optic can be positioned after the beam spot shaper lens to increase the working distance. In another embodiment, diffractive or reflective optical element may be positioned in front of one or more fiber optics or plurality of fiber optics. A positive refractive lens may be added after the diffractive or reflective optical element to focus the beam pattern or shape to multiple foci.

In accordance with one or more embodiments, the refractive lenses may generally be built around a lens profile, lens refracting material in the near-IR and mid-IR and coated with a material to reduce light reflection and absorption at the boundary layer. One or more negative lens profiles may comprise of biconcave, piano-concave, negative meniscus, or a gradient refractive index with a piano-concave profile, biconvex, or negative meniscus. One or more positive refractive lens profiles may comprise of biconvex, positive meniscus, or gradient refractive index lens with a piano-convex gradient profile, a biconvex gradient profile, or positive meniscus. The refractive lenses may be flat, cylindrical, spherical, aspherical, or a molded shape. One or more collimator lens profiles may comprise an aspheric lens, spherical lens system composed of a convex lens, thick convex lens, negative meniscus, and bi-convex lens, gradient refractive lens with an aspheric profile and achromatic doublets. The refractive lens material may be made of any desired material, such as fused silica, ZnSe, sapphire, quartz or diamond.

One or more embodiments may generally include one or more features to protect the optical element system and/or fiber laser downhole. In accordance with one or more embodiments, reflective and refractive lenses may include a cooling system. A refractive lens damage threshold power may include ~1 kW/cm2 or less to 1 MW/cm2. The cooling may generally function to cool the refractive and reflective mirrors below their damage threshold using cooling by a liquid or gas. The liquid cooling the reflective and refractive optics may cool below 20 degrees Celsius at the surface or in a downhole environment reaching temperatures exceeding 300 degrees Celsius. In some embodiments, one or multiple heat spreading fans may be attached to the optical element system to cool the reflective and/or refractive mirrors.

In accordance with one or more embodiments, the one or more lasers, fibers, or plurality of fiber bundles and the optical element systems to generate one or more beam spots, shape, or patterns from the above light emitting sources forming an optical head may be protected from downhole pressure and environments by being encased in an appropriate material. Such materials may include steel, titanium, diamond, tungsten carbide and the like as well as the other materials provided herein and known to those skilled in the art. A transmissive window may be made of a material that can withstand the downhole environment, while retaining transmissive qualities. One such material may be sapphire or other materials with similar qualities. An optical head may be entirely encased by sapphire. In at least one embodiment, the optical head may be made of diamond, tungsten carbide, steel, and titanium other than part where the laser beam is emitted.

In accordance with one or more embodiments, the fiber optics forming a pattern can send any desired amount of power. In some non-limiting embodiments, fiber optics may send up to 10 kW or more per a fiber. The fibers may transmit any desired wavelength. In some embodiments, the range of wavelengths the fiber can transmit may preferably be between about 800 nm and 2100 nm. The fiber can be connected by a connector to another fiber to maintain the proper fixed distance between one fiber and neighboring fibers. For example, fibers can be connected such that the beam spot from neighboring optical fibers when irradiating the material, such as a rock surface are non-overlapping to the particular optical fiber. The fiber may have any desired core size. In some embodiments, the core size may range from about 50 microns to 600 microns. The fiber can be single mode or multimode. If multimode, the numerical aperture of some embodiments may range from 0.1 to 0.6. A lower numerical aperture may be preferred for beam quality, and a higher numerical aperture may be easier to transmit higher powers with lower interface losses. In some embodiments, a fiber laser emitted light at wavelengths comprised of 1060 nm to 1080 nm, 1530 nm to 1600 nm, 1800 nm to 2100 nm, diode lasers from 400 nm to 2100 nm, $C0_2$ Laser at 10,600 nm, or Nd:YAG Laser emitting at 1064 nm can couple to the optical fibers. In some embodiments, the fiber can have a low water content. The fiber can be jacketed, such as with polyimide, acrylate, carbon polyamide, and carbon/dual acrylate or other material. If requiring high temperatures, a polyimide or a derivative material may be used to operate at temperatures over 300 degrees Celsius. The fibers can be a hollow core photonic crystal or solid core photonic crystal. In some embodiments, using hollow core photonic crystal fibers at wavelengths of 1500 nm or higher may minimize absorption losses.

The use of the plurality of optical fibers can be bundled into a number of configurations to improve power density. The optical fibers forming a bundle may range from two fibers at hundreds of watts to kilowatt powers in each fiber to millions of fibers at milliwatts or microwatts of power.

In accordance with one or more embodiments, one or more diode lasers can be sent downhole with an optical element system to form one or more beam spots, shapes, or patterns. The one or more diode lasers will typically require control over divergence. For example, using a collimator a focus distance away or a beam expander and then a collimator may be implemented. In some embodiments, more than one diode laser may couple to fiber optics, where the fiber optics or a plurality of fiber optic bundles form a pattern of beam spots irradiating the material, such as a rock surface. In another embodiment, a diode laser may feed a single mode fiber laser head. Where the diode laser and single mode fiber laser head are both downhole or diode laser is above hole and fiber laser head is downhole, the light being irradiated is collimated and an optical lens system would not require a collimator. In another embodiment, a fiber laser head unit may be separated in a pattern to form beam spots to irradiate the rock surface.

Figure 1B:
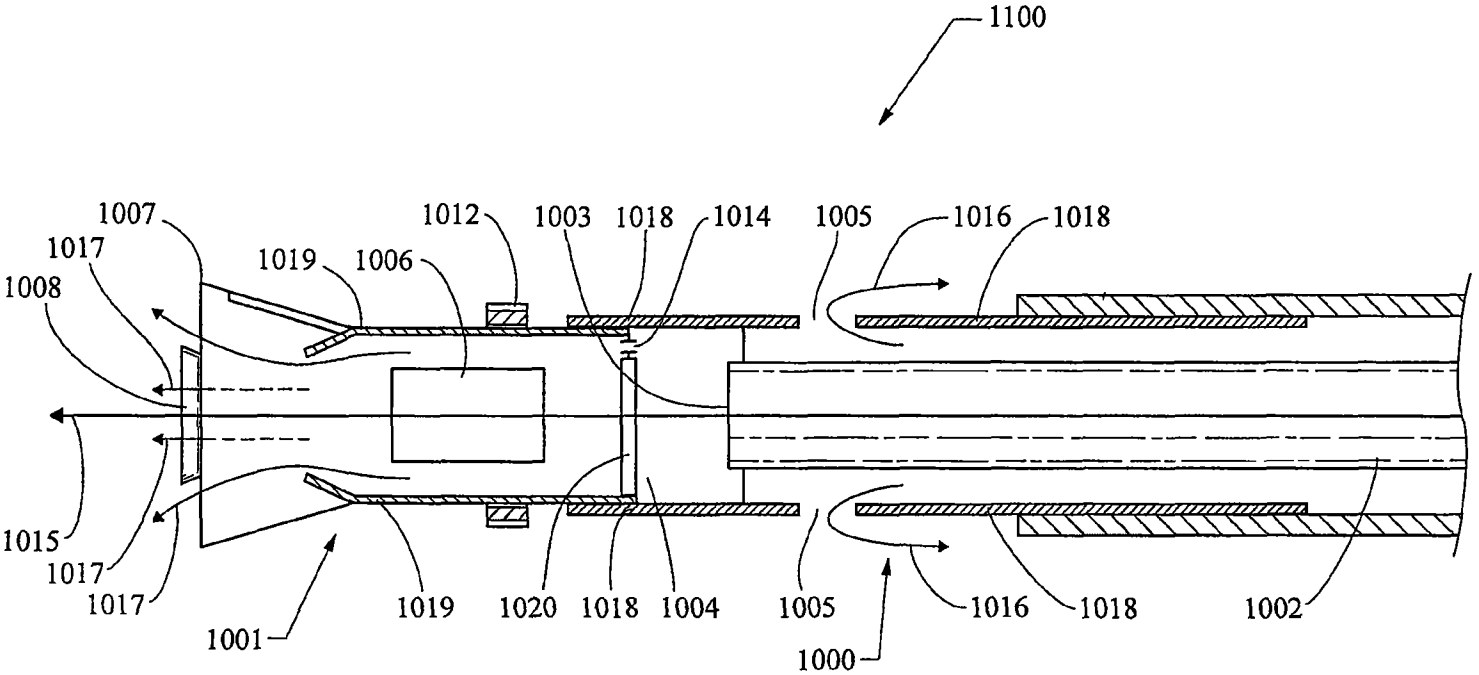
FIG. 1B is a cross sectional view of the LBHA of FIG. 1A taken along B-B.

Thus, by way of example, an LBHA is illustrated in FIGS. 1A and B, which are collectively referred as FIG. 1. Thus, there is provided a LBHA 1100, which has an upper part 1000 and a lower part 1001. The upper part 1000 has housing 1018 and the lower part 1001 has housing 1019. The LBHA 1100, the upper part 1000, the lower part 1001 and in particular the housings 1018, 1019 should be constructed of materials and designed structurally to withstand the extreme conditions of the deep downhole environment and protect any of the components that are contained within them.

The upper part 1000 may be connected to the lower end of the coiled tubing, drill pipe, or other means to lower and retrieve the LBHA 1100 from the borehole. Further, it may be connected to stabilizers, drill collars, or other types of downhole assemblies (not shown in the figure), which in turn are connected to the lower end of the coiled tubing, drill pipe, or other means to lower and retrieve the LBHA 1100 from the borehole. The upper part 1000 further contains, is connect to, or otherwise optically associated with the means 1002 that transmitted the high power laser beam down the borehole so that the beam exits the lower end 1003 of the means 1002 and ultimately exists the LBHA 1100 to strike the intended surface of the borehole. The beam path of the high power laser beam is shown by arrow 1015. In FIG. 1 the means 1002 is shown as a single optical fiber. The upper part 1000 may also have air amplification nozzles 1005 that discharge the drilling fluid, for example $N_2$, to among other things assist in the removal of cuttings up the borehole.

The upper part 1000 further is attached to, connected to or otherwise associated with a means to provide rotational movement 1010. Such means, for example, would be a downhole motor, an electric motor or a mud motor. The motor may be connected by way of an axle, drive shaft, drive train, gear, or other such means to transfer rotational motion 1011, to the lower part 1001 of the LBHA 1100. It is understood, as shown in the drawings for purposes of illustrating the underlying apparatus, that a housing or protective cowling may be placed over the drive means or otherwise associated with it and the motor to protect it from debris and harsh downhole conditions. In this manner the motor would enable the lower part 1001 of the LBHA 1100 to rotate. An example of a mud motor is the CAVO 1.7" diameter mud motor. This motor is about 7 ft long and has the following specifications: 7 horsepower @110 ft-lbs full torque; motor speed 0-700 rpm; motor can run on mud, air, $N_2$, mist, or foam; 180 SCFM, 500-800 psig drop; support equipment extends length to 12 ft; 10:1 gear ratio provides 0-70 rpm capability; and has the capability to rotate the lower part 1001 of the LBHA through potential stall conditions.

The upper part 1000 of the LBHA 1100 is joined to the lower part 1001 with a sealed chamber 1004 that is transparent to the laser beam and forms a pupil plane 1020 to permit unobstructed transmission of the laser beam to the beam shaping optics 1006 in the lower part 1001. The lower part 1001 is designed to rotate. The sealed chamber 1004 is in fluid communication with the lower chamber 1001 through port 1014. Port 1014 may be a one way valve that permits clean transmissive fluid and preferably gas to flow from the upper part 1000 to the lower part 1001, but does not permit reverse flow, or if may be another type of pressure and/or flow regulating value that meets the particular requirements of desired flow and distribution of fluid in the downhole environment. Thus, for example there is provided in FIG. 1 a first fluid flow path, shown by arrows 1016, and a second fluid flow path, shown by arrows 1017. In the example of FIG. 1 the second fluid flow path is a laminar flow although other flows including turbulent flows may be employed.

The lower part 1001 has a means for receiving rotational force from the motor 1010, which in the example of the figure is a gear 1012 located around the lower part housing 1019 and a drive gear 1013 located at the lower end of the axle 1011. Other means for transferring rotational power may be employed or the motor may be positioned directly on the lower part. It being understood that an equivalent apparatus may be employed which provide for the rotation of the portion of the LBHA to facilitate rotation or movement of the laser beam spot while at the same time not providing undue rotation, or twisting forces, to the optical fiber or other means transmitting the high power laser beam down the hole to the LBHA. In his way laser beam spot can be rotated around the bottom of the borehole. The lower part 1001 has a laminar flow outlet 1007 for the fluid to exit the LBHA 1100, and two hardened rollers 1008, 1009 at its lower end. Although a laminar flow is contemplated in this example, it should be understood that non-laminar flows, and turbulent flows may also be employed.

The two hardened rollers may be made of a stainless steel or a steel with a hard face coating such as tungsten carbide, chromium-cobalt-nickel alloy, or other similar materials. They may also contain a means for mechanically cutting rock that has been thermally degraded by the laser. They may range in length from about 1 in to about 4 in and preferably are about 2-3 in and may be as large or larger than 6 inches. (As used herein the term length refers to the rollers largest dimension) Moreover in LBHAs for drilling larger diameter boreholes they may be in the range of 10-20 inches to 30 inches in diameter.

Thus, FIG. 1 provides for a high power laser beam path 1015 that enters the LBHA 1100, travels through beam spot shaping optics 1006, and then exits the LBHA to strike its intended target on the surface of a borehole. Further, although it is not required, the beam spot shaping optics may also provide a rotational element to the spot, and if so, would be considered to be beam rotational and shaping spot optics.

In use the high energy laser beam, for example greater than 15 kW, would enter the LBHA 1100, travel down fiber 1002, exit the end of the fiber 1003 and travel through the sealed chamber 1004 and pupil plane 1020 into the optics 1006, where it would be shaped and focused into a spot, the optics 1006 would further rotate the spot. The laser beam would then illuminate, in a potentially rotating manner, the bottom of the borehole spalling, chipping, melting and/or vaporizing the rock and earth illuminated and thus advance the borehole. The lower part would be rotating and this rotation would further cause the rollers 1008, 1009 to physically dislodge any material that was effected by the laser or otherwise sufficiently fixed to not be able to be removed by the flow of the drilling fluid alone.

The cuttings would be cleared from the laser path by the flow of the fluid along the path 1017, as well as, by the action of the rollers 1008, 1009 and the cuttings would then be carried up the borehole by the action of the drilling fluid from the air amplifiers 1005, as well as, the laminar flow opening 1007.

It is understood that the configuration of the LBHA is FIG. 1 is by way of example and that other configurations of its components are available to accomplish the same results. Thus, the motor may be located in the lower part rather than the upper part, the motor may be located in the upper part but only turn the optics in the lower part and not the housing. The optics may further be located in both the upper and lower parts, which the optics for rotation being positioned in that part which rotates. The motor may be located in the lower part but only rotate the optics and the rollers. In this later configuration the upper and lower parts could be the same, i.e., there would only be one part to the LBHA. Thus, for example the inner portion of the LBHA may rotate while the outer portion is stationary or vice versa, similarly the top and/or bottom portions may rotate or various combinations of rotating and non-rotating components may be employed, to provide for a means for the laser beam spot to be moved around the bottom of the borehole.

The optics 1006 should be selected to avoid or at least minimize the loss of power as the laser beam travels through them. The optics should further be designed to handle the extreme conditions present in the downhole environment, at least to the extent that those conditions are not mitigated by the housing 1019. The optics may provide laser beam spots of differing power distributions and shapes as set forth herein above. The optics may further provide a sign spot or multiple spots as set forth herein above. Further examples of optics, beam profiles and high power laser beam spots for use in and with a LBHA are provide are disclosed in greater detail in co-pending U.S. patent application Ser. No. 12/544,094, which issued as U.S. Pat. No. 8,424,617, the disclosure of which is incorporate herein by reference in its entirety. Further examples of fluid delivery means and means to keep the laser path clear of debris in an LBHA are provide and disclosed in detail in co-pending U.S. patent application Ser. No. 12/543,968, the disclosure of which is incorporate herein by reference in its entirety.

Figure 2:
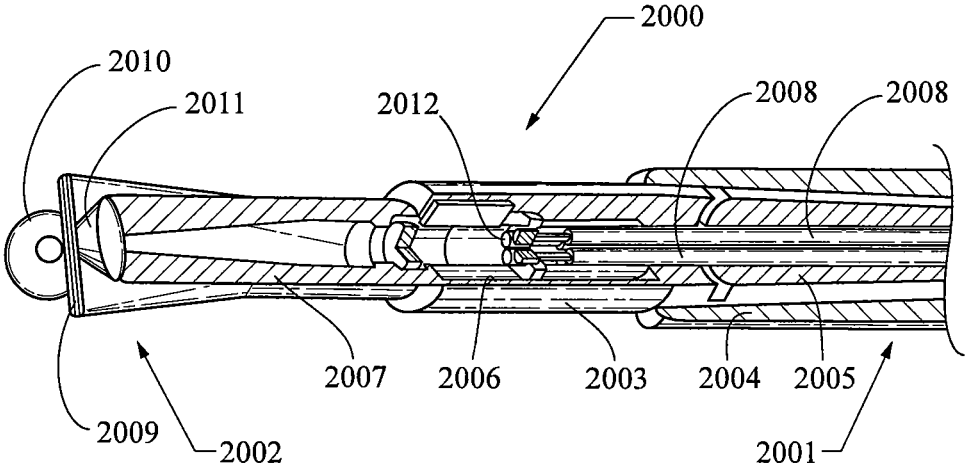
FIG. 2 cutaway view of an LBHA.

In general, and by way of further example, there is provided in FIG. 2 a LBHA 2000 comprises an upper end 9001, and a lower end 9002. The high power laser beam enters through the upper end 9001 and exist through the lower end 9002 in a predetermined selected shape for the removal of material in a borehole, including the borehole surface, casing, or tubing. The LBHA 2000 further comprises a housing 9003, which may by way of example, be made up of sub-housings 2004, 2005, 2006 and 2007. These sub-housings may be integral, they may be separable, they may be removably fixedly connected, they may be rotatable, or there may be any combination of one or more of these types of relationships between the sub-housings. The LBHA 2000 may be connected to the lower end of the coiled tubing, drill pipe, or other means to lower and retrieve the LBHA

2000 from the borehole. Further, it may be connected to stabilizers, drill collars, or other types of down hole assemblies (not shown in the figure) which in turn are connected to the lower end of the coiled tubing, drill pipe, or other means to lower and retrieve the bottom hole assembly from the borehole. The LBHA 2000 has associated therewith a means 2008 that transmitted the high power energy from down the borehole. In FIG. 2 this means 2008 is a bundle four optical cables.

The LBHA may also have associated with, or in, it means to handle and deliver drilling fluids. These means may be associated with some or all of the sub-housings. In FIG. 2 there is provided, as such a means, a nozzle 2009 in sub-housing 2007. There are further provided mechanical scraping means, e.g. a Polycrystalline diamond composite or compact (PDC) bit and cutting tool, to remove and/or direct material in the borehole, although other types of known bits and/or mechanical drilling heads by also be employed in conjunction with the laser beam. In FIG. 2, such means are show by hardened scrapers 2010 and 2011. These scrapers may be mechanically interacted with the surface or parts of the borehole to loosen, remove, scrap or manipulate such borehole material as needed. These scrapers may be from less than about 1 in to about 20 in. in length. In use the high energy laser beam, for example greater than 15 kW, would travel down the fibers 2008 through 2012 optics and then out the lower end 2002 of the LBHA 2000 to illuminate the intended part of the borehole, or structure contained therein, spalling, melting and/or vaporizing the material so illuminated and thus advance the borehole or otherwise facilitating the removal of the material so illuminated. Thus, these types of mechanical means which may be crushing, cutting, gouging scraping, grinding, pulverizing, and shearing tools, or other tools used for mechanical removal of material from a borehole, may be employed in conjunction with or association with a LBHA. As used herein the "length" of such tools refers to its longest dimension.

In general, the output at the end of the fiber cable may consist of one or many optical fibers. The beam shape at the rock once determined can be created by either reimaging the fiber (bundle), collimating the fiber (bundle) and then transforming it to the Fourier plane to provide a homogeneous illumination of the rock surface, or after collimation a diffractive optic, micro-optic or axicon array could be used to create the beam patterned desired. This beam pattern can be applied directly to the rock surface or reimaged, or Fourier transformed to the rock surface to achieve the desired pattern. The processing head may include a dichroic splitter to allow the integration of a camera or a fiber optic imaging system monitoring system into the processing head to allow progress to be monitored and problem to be diagnosed.

Drilling may be conducted in a dry environment or a wet environment. An important factor is that the path from the laser to the rock surface should be kept as clear as practical of debris and dust particles or other material that would interfere with the delivery of the laser beam to the rock surface. The use of high brightness lasers provides another advantage at the process head, where long standoff distances from the last optic to the work piece are important to keeping the high pressure optical window clean and intact through the drilling process. The beam can either be positioned statically or moved mechanically, optomechanically, electro-optically, electromechanically, or any combination of the above to illuminate the earth region of interest.

Figure 3A:
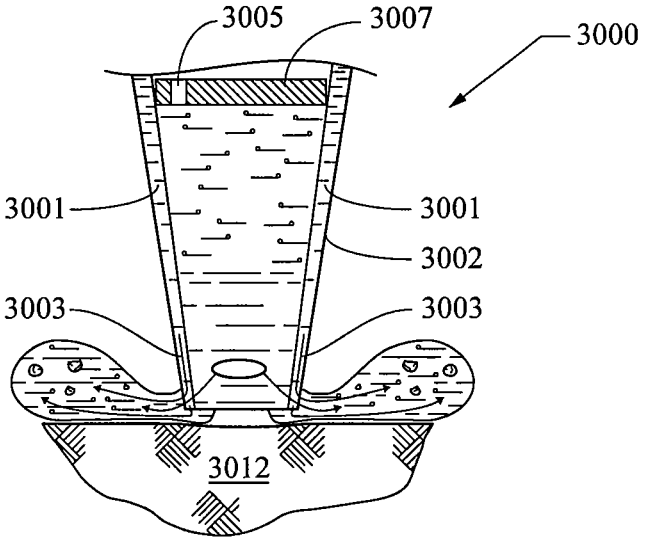
FIGS. 3A & 3B are cross sectional views of an LBHA.
Figure 3B:
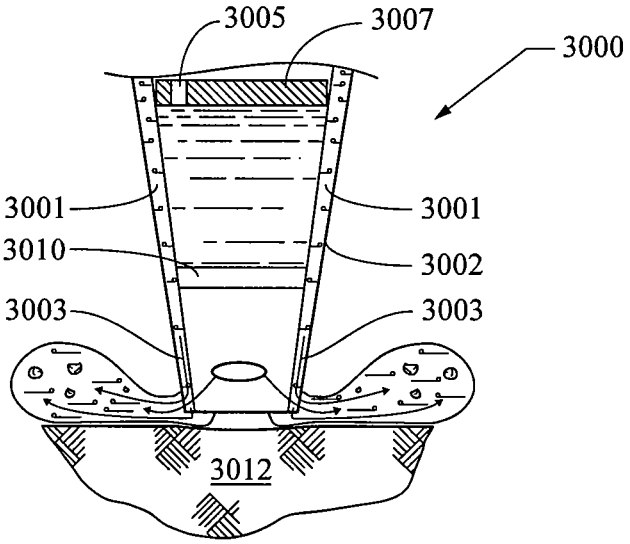

The optical path must be kept clean of debris whether the process is performed in a dry environment or a wet environment. If the process is performed in a dry environment, high pressure gas can be pumped into the nozzle to provide sufficient force to prevent rock chips from hitting the high pressure window. This high pressure gas can also keep the nozzle area clear of debris by forcing the dust and debris out of the process area. In a wet environment, the nozzle is pressurized by high pressure air and high pressure water at a lower pressure flows on the outside of the nozzle toward the rock surface. An example of this configuration is provided in FIGS. 3A & B there is provided an LBHA 3000. Thus, there is provided a fluid path 3001 that is positioned within or associated with the outer wall 3002 of the LBHA 3000. The fluid flow is shown in FIG. 3A by arrows 3003. In use as the fluid flows down the LBHA small aspiration holes on the inside wall of the LBHA create an aspiration pumping mechanism and have the effect of sucking gas and debris from within the LBHA. There is further provided a high pressure gas inlet 3005, a high pressure window 3007 and a movable seal 3010. When not under pressure or in use the seal 3010 can be dosed as shown in FIG. 3B. The earth at the bottom of a borehole 3012 is provided for reference. Thus, in FIG. 3 there is provided an example of the concept for delivering a laser beam to the bottom of the borehole using air pressurized water to hold back the fluids outside of the nozzle. This method is similar to that used for excavating caissons. Additionally, as the outer fluid flows past a series of channels the fluid drags the gas along creating a pumping effect. This pumping effect is a phenomenon known as aspiration pumping. Accordingly, as debris is formed, it is forced out of the nozzle area by the high pressure gas and carried away by the high pressure water flow. By adding ports to the nozzle between the high pressure gas region and the high pressure/high flow water region it is possible to create a suction that can pull the dust and debris from the processing region.

Another consideration is to build the nozzle like a caisson, where the edge of the nozzle is constructed of high strength steel coated with an even harder material such nickel chrome (Chromalloy) or a Tungsten Carbide surface. The nozzle provides a high pressure load by the weight of the shaft holding the nozzle to the bottom of the well. As the laser is used to rapidly heat the region adjacent to the nozzle edge, the rock fractures from the combined stresses induced by the nozzle and the heat. The nozzle is pressurized with high pressure gas to clear out the debris after the rock shatters. This combination of heat and mechanical pressure could prove to be a very efficient means to drill through even the hardest materials. Finally, by pulsing the lasers it may be feasible to increase the drilling rate even further by creating rapid transient stresses that cause rapid spallation locally followed by more massive chipping from the mechanical stresses induced by the nozzle.

Figure 4:
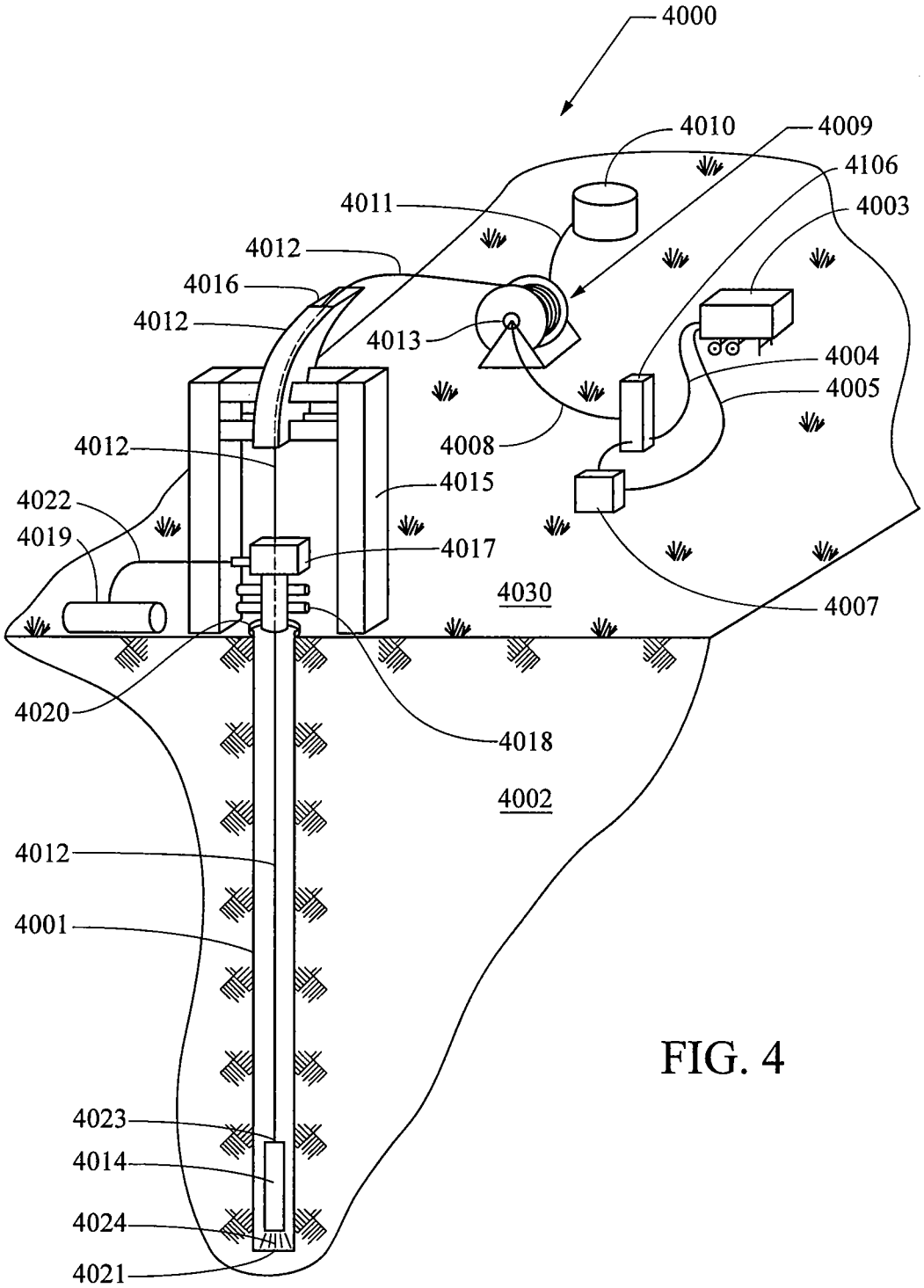
FIG. 4 is a laser drilling system.

Thus, in general, and by way of example, there is provided in FIG. 4 a high efficiency laser drilling system that the LBHA of the present invention my be employed with. Such systems are disclosed in greater detail in co-pending U.S. patent application Ser. No. 12/544,136, which issued as U.S. Pat. No. 8,511,401, the disclosure of which is incorporate herein by reference in its entirety.

Thus, in general, and by way of example, there is provided in FIG. 4 a high efficiency laser drilling system 4000 for creating a borehole 4001 in the earth 4002. As used herein the term "earth" should be given its broadest possible meaning (unless expressly stated otherwise) and would include, without limitation, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

FIG. 4 provides a cut away perspective view showing the surface of the earth 4030 and a cut away of the earth below the surface 4002. In general and by way of example, there is provided a source of electrical power 4003, which provides electrical power by cables 4004 and 4005 to a laser 4006 and a chiller 4007 for the laser 4006. The laser provides a laser beam, i.e., laser energy, that can be conveyed by a laser beam transmission means 4008 to a spool of coiled tubing 4009. A source of fluid 4010 is provided. The fluid is conveyed by fluid conveyance means 4011 to the spool of coiled tubing 4009.

The spool of coiled tubing 4009 is rotated to advance and retract the coiled tubing 4012. Thus, the laser beam transmission means 4008 and the fluid conveyance means 4011 are attached to the spool of coiled tubing 4009 by means of rotating coupling means 4013. The coiled tubing 4012 contains a means to transmit the laser beam along the entire length of the coiled tubing, i.e., "long distance high power laser beam transmission means," to the bottom hole assembly, 4014. The coiled tubing 4012 also contains a means to convey the fluid along the entire length of the coiled tubing 4012 to the bottom hole assembly 4014.

Additionally, there is provided a support structure 4015, which for example could be derrick, crane, mast, tripod, or other similar type of structure. The support structure holds an injector 4016, to facilitate movement of the coiled tubing 4012 in the borehole 4001. As the borehole is advance to greater depths from the surface 4030, the use of a diverter 4017, a blow out preventer (BOP) 4018, and a fluid and/or cutting handling system 4019 may become necessary. The coiled tubing 4012 is passed from the injector 4016 through the diverter 4017, the BOP 4018, a wellhead 4020 and into the borehole 4001.

The fluid is conveyed to the bottom 4021 of the borehole 4001. At that point the fluid exits at or near the bottom hole assembly 4014 and is used, among other things, to carry the cuttings, which are created from advancing a borehole, back up and out of the borehole. Thus, the diverter 4017 directs the fluid as it returns carrying the cuttings to the fluid and/or cuttings handling system 4019 through connector 4022. This handling system 4019 is intended to prevent waste products from escaping into the environment and either vents the fluid to the air, if permissible environmentally and economically, as would be the case if the fluid was nitrogen, returns the cleaned fluid to the source of fluid 4010, or otherwise contains the used fluid for later treatment and/or disposal.

The BOP 4018 serves to provide multiple levels of emergency shut off and/or containment of the borehole should a high-pressure event occur in the borehole, such as a potential blow-out of the well. The BOP is affixed to the wellhead 4020. The wellhead in turn may be attached to casing. For the purposes of simplification the structural components of a borehole such as casing, hangers, and cement are not shown. It is understood that these components may be used and will vary based upon the depth, type, and geology of the borehole, as well as, other factors.

The downhole end 4023 of the coiled tubing 4012 is connect to the bottom hole assembly 4014. The bottom hole assemble 4014 contains optics for delivering the laser beam 4024 to its intended target, in the case of FIG. 4, the bottom 4021 of the borehole 4001. The bottom hole assemble 4014, for example, also contains means for delivering the fluid.

There is provided by way of examples illustrative and simplified plans of potential drilling scenarios using the laser drilling systems and apparatus of the present invention.

| | Depth | Rock type | Drilling type/Laser power down hole |
|---|---|---|---|
| Drill 17½ inch hole | Surface-3000 ft | Sand and shale | Conventional mechanical drilling |
| Run 13⅜ inch casing | Length 3000 ft | | |
| Drill 12¼ inch hole | 3000 ft-8,000 ft | basalt | 40 kW (minimum) |
| Run 9⅝ inch casing | Length 8,000 ft | | |
| Drill 8½ inch hole | 8,000 ft-11,000 ft | limestone | Conventional mechanical drilling |
| Run 7 inch casing | Length 11,000 ft | | |
| Drill 6¼ inch hole | 11,000 ft-14,000 ft | Sand stone | Conventional mechanical drilling |
| Run 5 inch liner | Length 3000 ft | | |

| | Depth | Rock type | Drilling type/Laser power down hole |
|---|---|---|---|
| Drill 17½ inch hole | Surface-500 ft | Sand and shale | Conventional mechanical drilling |
| Run 13⅜ casing | Length 500 ft | | |
| Drill 12¼ hole | 500 ft-4,000 ft | granite | 40 kW (minimum) |
| Run 9⅝ inch casing | Length 4,000 ft | | |
| Drill 8½ inch hole | 4,000 ft-11,000 ft | basalt | 20 kW (mimimum) |
| Run 7 inch casing | Length 11,000 ft | | |
| Drill 6¼ inch hole | 11,000 ft-14,000 ft | Sand stone | Conventional mechanical drilling |
| Run 5 inch liner | Length 3000 ft | | |

Thus, in general this system operates to create and/or advance a borehole by having the laser create laser energy in the form of a laser beam. The laser beam is then transmitted from the laser through the spool and into the coiled tubing. At which point, the laser beam is then transmitted to the bottom hole assembly where it is directed toward the surfaces of the earth and/or borehole. Upon contacting the surface of the earth and/or borehole the laser beam has sufficient power to cut, or otherwise effect, the rock and earth creating and/or advancing the borehole. The laser beam at the point of contact has sufficient power and is directed to the rock and earth in such a manner that it is capable of borehole creation that is comparable to or superior to a conventional mechanical drilling operation. Depending upon the type of earth and rock and the properties of the laser beam this cutting occurs through spalling, thermal dissociation, melting, vaporization and combinations of these phenomena.

Although not being bound by the present theory, it is presently believed that the laser material interaction entails the interaction of the laser and a fluid or media to clear the area of laser illumination. Thus the laser illumination creates a surface event and the fluid impinging on the surface rapidly transports the debris, i.e. cuttings and waste, out of the illumination region. The fluid is further believed to remove heat either on the macro or micro scale from the area of illumination, the area of post-illumination, as well as the borehole, or other media being cut, such as in the case of perforation.

The fluid then carries the cuttings up and out of the borehole. As the borehole is advanced the coiled tubing is unspooled and lowered further into the borehole. In this way the appropriate distance between the bottom hole assembly and the bottom of the borehole can be maintained. If the bottom hole assembly needs to be removed from the borehole, for example to case the well, the spool is wound up, resulting in the coiled tubing being pulled from the borehole. Additionally, the laser beam may be directed by the bottom hole assembly or other laser directing tool that is placed down the borehole to perform operations such as perforating, controlled perforating, cutting of casing, and removal of plugs. This system may be mounted on readily mobile trailers or trucks, because its size and weight are substantially less than conventional mechanical rigs.

The novel and innovative apparatus of the present invention, as set forth herein, may be used with conventional drilling rigs and apparatus for drilling, completion and related and associated operations. The apparatus and methods of the present invention may be used with drilling rigs and equipment such as in exploration and field development activities. Thus, they may be used with, by way of example and without limitation, land based rigs, mobile land based rigs, fixed tower rigs, barge rigs, drill ships, jack-up platforms, and semi-submersible rigs. They may be used in operations for advancing the well bore, finishing the well bore and work over activities, including perforating the production casing. They may further be used in window cutting and pipe cutting and in any application where the delivery of the laser beam to a location, apparatus or component that is located deep in the well bore may be beneficial or useful.

From the foregoing description, one skilled in the art can readily ascertain the essential characteristics of this invention, and without departing from the spirit and scope thereof, can make various changes and/or modifications of the invention to adapt it to various usages and conditions.

What is claimed:

1. A high power laser exploration and production system for downhole activities comprising:

a. a source of high power laser energy, the laser source capable of providing a laser beam having a power of at least about 10 kW;

b. a tubing assembly, the tubing assembly having at least 1000 feet of tubing, having a distal end and a proximal;

c. the proximal end of the tubing being in optical communication with the laser source, whereby the laser beam can be transmitted in association with the tubing;

d. the tubing comprising a high power laser transmission cable, the transmission cable having a distal end and a proximal end, the proximal end being in optical communication with the laser source, whereby the laser beam is transmitted by the cable from the proximal end to the distal end of the cable for delivery of the laser beam energy to a laser downhole tool assembly; and, e. the laser downhole tool assembly comprising;

i. a body comprising a first rotating housing and a second fixed housing;

ii. an optical assembly;

iii. at least a portion of the optical assembly mechanically associated with the first rotating housing, whereby the mechanically associated portion rotates with the first housing;

iv. the high power laser transmission cable mechanically associated with the second housing; and, v. a fluid path associated with the first rotating and second fixed housings, the fluid path having a distal and proximal opening, whereby the fluid path extends between the first rotating and second fixed housings;

vi. the fluid path distal opening adapted to discharge the fluid in a discharge fluid path, the optical assembly adapted to direct the laser beam in a laser beam path; and, vii. the discharge fluid path and laser beam path directed toward a downhole laser target surface for having a laser operation performed; whereby the fluid is capable of being transmitted along the discharged fluid path toward the downhole laser target surface to clear waste material from the laser operation.

2. The system of claim 1, wherein the optical assembly comprises a beam shaping optic.

3. The system of claim 1, wherein the laser beam has a wavelength of from 1060 nm to 1080 nm.

4. The system of claim 1, wherein the laser downhole tool assembly comprises a means for rotating the first housing.

5. The system of claim 1, wherein the laser beam has a wavelength of from 400 nm to 2100 nm.

6. The system of claim 1, wherein the high power laser source is a diode laser.

7. The system of claim 1, wherein the laser source comprises a plurality of high power lasers.

8. A high power laser system for performing laser operations comprising:

a. a source of high power laser energy, the laser source capable of providing a laser beam;

b. a conveyance assembly, the conveyance assembly having at least 200 feet of tubing, having a distal end and a proximal;

c. a source of fluid for use in performing a downhole laser operation in a borehole;

d. the proximal end of the conveyance assembly being in fluid communication with the source of fluid, whereby fluid is transported in association with the conveyance assembly from the proximal end of the conveyance assembly to the distal end of the conveyance assembly;

e. the proximal end of the conveyance assembly being in optical communication with the laser source, whereby the laser beam can be transported in association with the conveyance assembly;

f. the conveyance assembly comprising a high power laser transmission cable, the transmission cable having a distal end and a proximal end, the proximal end being in optical communication with the laser source, whereby the laser beam is transmitted by the cable from the proximal end to the distal end of the cable; and, g. a laser downhole tool assembly in optical and fluid communication with the distal end of the conveyance assembly; and, h. the laser downhole tool assembly comprising;

i. a body comprising a first rotating housing and a second fixed housing;

ii. an optical assembly;

iii. at least a portion of the optical assembly mechanically associated with the first rotating housing, whereby the mechanically associated portion rotates with the first housing;

iv. the high power laser transmission cable mechanically associated with the second housing; and, v. a fluid path associated with the first rotating and second fixed housings, the fluid path having a distal and proximal opening, whereby the fluid path extends between the first rotating and second fixed housings;

vi. the fluid path distal opening adapted to discharge a fluid in a discharge fluid path, the optical assembly adapted to direct the laser beam in a laser beam path; and, vii. the discharge fluid path and laser beam path directed toward a downhole laser target area for having a laser operation performed; whereby the fluid is capable of being transmitted along the discharge fluid path toward the downhole laser target area to clear waste material from the laser operation.

9. The system of claim 8, wherein the optical assembly comprises a beam shaping optic.

10. The system of claim 8, wherein the laser beam has a wavelength of from 1060 nm to 1080 nm.

11. The system of claim 8, wherein the laser downhole tool assembly comprises a means for rotating the first housing.

12. The system of claim 8, wherein the laser beam has a wavelength of from 400 nm to 2100 nm.

13. The system of claim 8, wherein the high power laser source is a diode laser.

14. The system of claim 1, wherein the laser source has a power of at least about 20 kW.

15. The system of claim 8, wherein the laser source has a power of at least about 10 kW.

16. The system of claim 8, wherein the laser source comprises a plurality of high power lasers.

17. A high power laser system for performing laser operations, the system comprising:

a. a source of high power laser energy, the laser source capable of providing a laser beam;

b. a conveyance assembly, the conveyance assembly having a distal end and a proximal end and defining a length of at least 200 feet there between;

c. a source of fluid for use in performing a laser operation;

d. the proximal end of the conveyance assembly being in fluid communication with the source of fluid, whereby fluid is transported from the proximal end of the conveyance assembly to the distal end of the conveyance assembly;

e. a high power laser transmission cable, the transmission cable having a distal end and a proximal end, the proximal end being in optical communication with the laser source, whereby the laser beam is transmitted by the cable from the proximal end to the distal end of the cable;

f. a laser tool assembly in mechanical and fluid communication with the distal end of the conveyance assembly; and, h. the laser tool assembly comprising;

i. a body comprising a first rotating housing and a second fixed housing;

ii. an optical assembly;

iii. at least a portion of the optical assembly mechanically associated with the first rotating housing, whereby the mechanically associated portion rotates with the first housing;

iv. the optical assembly optically associated with the high power laser transmission cable, whereby the laser beam is provided to the optical assembly; and, v. a fluid path associated with the first rotating and second fixed housings, the fluid path having a distal and proximal opening, whereby the fluid path extends between the first rotating and second fixed housings;

vi. the fluid path distal opening adapted to discharge the fluid in a discharge fluid path, the optical assembly adapted to direct the laser beam in a laser beam path; and, vii. the discharge fluid path and laser beam path directed toward a downhole laser target surface for having a laser operation performed thereon; whereby the fluid is capable of being discharged from the distal opening and transmitted along the discharge fluid path toward the downhole laser target surface to clear waste material from the laser operation.

18. The system of claim 17, wherein the optical assembly comprises a beam shaping optic.

19. The system of claim 17, wherein the laser beam has a wavelength of from 1060 nm to 1080 nm.

20. The system of claim 17, wherein the laser tool assembly comprises a means for rotating the first housing.

21. The system of claim 17, wherein the laser beam has a wavelength of from 400 nm to 2100 nm.

22. The system of claim 17, wherein the high power laser source is a diode laser.

23. The system of claim 17, wherein the laser source has a power of at least about 10 kW.

24. The system of claim 17, wherein the laser source has a power of at least about 20 kW.

25. The system of claim 17, wherein the laser source comprises a plurality of high power lasers.

26. A high power laser system for performing oil field laser operations, the system comprising:

a. a source of high power laser energy, the laser source capable of providing a laser beam;

b. a conveyance assembly, the conveyance assembly having having a distal end and a proximal end and defining a length of at least 100 feet there between;

c. a source of fluid for use in performing a laser operation;

d. the proximal end of the conveyance assembly being in fluid communication with the source of fluid, whereby fluid is transported from the proximal end of the conveyance assembly to the distal end of the conveyance assembly;

e. a high power laser transmission cable, the transmission cable having a distal end and a proximal end, the proximal end being in optical communication with the laser source, whereby the laser beam is transmitted by the cable from the proximal end to the distal end of the cable;

f. a laser oil field operations tool assembly in mechanical and fluid communication with the distal end of the conveyance assembly; and, h. the laser oil field operations tool assembly comprising;

i. a body comprising a first rotating housing and a second fixed housing;

ii. an optical assembly;

iii. at least a portion of the optical assembly mechanically associated with the first rotating housing, whereby the mechanically associated portion rotates with the first housing;

iv. the optical assembly optically associated with the high power laser transmission cable, whereby the laser beam is provided to the optical assembly; and, v. a fluid path associated with the first rotating and second fixed housings, the fluid path having a distal and proximal opening;

vi. the fluid path distal opening adapted to discharge the fluid in a discharge fluid path, the optical assembly adapted to direct the laser beam in a laser beam path; and, vii. the discharge fluid path and laser beam path directed toward a downhole laser target area for having a laser operation performed thereon; whereby the fluid is capable of being discharged from the distal opening and transmitted along the discharge fluid path toward the downhole laser target area to remove waste material from the laser operation.

* * * * *